US005638611A

United States Patent [19]

Oechsle

[11] Patent Number: 5,638,611

[45] Date of Patent: Jun. 17, 1997

[54] SINGLE-TIER DRYING SECTION TAILORED FOR COMPENSATING STRETCHING AND SHRINKING OF PAPER WEB

[75] Inventor: Markus Oechsle, Bartholomae, Germany

[73] Assignee: Voith Sulzer Papiermaschinen GmbH, Germany

[21] Appl. No.: 544,710

[22] Filed: Oct. 18, 1995

[51] Int. Cl.[6] ..... F26B 3/00

[52] U.S. Cl. ..... 34/447

[58] Field of Search ..... 34/443, 444, 447, 34/453, 454, 459

[56] References Cited

U.S. PATENT DOCUMENTS

| | | | |
|---|---|---|---|
| 1,513,369 | 10/1924 | Cadgene et al. | 34/447 |
| 2,932,901 | 4/1960 | Salem et al. | 34/447 X |
| 4,495,711 | 1/1985 | Justus | 34/444 |
| 4,820,947 | 4/1989 | Beisiegel et al. | 310/89 |
| 4,934,067 | 6/1990 | Wedel | 34/457 |
| 4,982,513 | 1/1991 | Loser et al. | 34/116 |
| 5,050,317 | 9/1991 | Kade et al. | 34/117 |
| 5,177,880 | 1/1993 | Preisetanz et al. | 34/117 |
| 5,269,074 | 12/1993 | Sims et al. | 34/117 |
| 5,311,672 | 5/1994 | Kotitschke et al. | 34/117 |
| 5,377,428 | 1/1995 | Clark | 34/447 X |
| 5,505,006 | 4/1996 | Wuiz et al. | 34/117 |

*Primary Examiner*—John M. Sollecito
*Assistant Examiner*—Steve Gravini
*Attorney, Agent, or Firm*—Ostrolenk, Faber, Gerb & Soffen, LLP

[57] ABSTRACT

A drying section for a paper making machine includes a larger number of dryer sections, fewer dryers in each dryer section, and provisions for driving many of the dryers individually. The average number of dryers per dryer section is less than five and preferably less than four. By providing a small number of dryers per dryer section and driving many of the dryers individually, it is possible to more precisely compensate for stretching of the paper web in the initial stages of the drying process and to more precisely compensate for shrinkage of the paper web during the latter stages of the drying process.

5 Claims, 5 Drawing Sheets

SINGLE-TIER DRYING SECTION TAILORED FOR COMPENSATING STRETCHING AND SHRINKING OF PAPER WEB

BACKGROUND OF THE INVENTION

The present invention relates to a drying section of a paper making machine and, more particularly, to a drying section comprised substantially entirely of sequentially arranged, top-felted, single tier dryer sections with a, comparatively, drastically reduced number of dryers within each dryer section to permit compensating for stretching and shrinkage of the paper web.

As used therein, the term "drying section" refers to that part of the paper machine which receives a web of paper emerging from the press section and which extends to the point where the paper web emerges from the drying section about 90 to 99% dry. The paper web proceeds from the drying section to subsequent sections of the machine, e.g. the calender, the coater, after dryer etc. As is well known, a drying section consists of several subsections comprising commonly felted drying cylinders. In the present patent specification, the term "dryer group" or "dryer section" designates a group of commonly felted dryer cylinders, except in a case of a double-tier dryer section where the co-extensive upper and lower dryers, although separately felted, are still considered by the art to be the same "dryer section."

As described in the present Assignee's U.S. Pat. No. 5,311,672, a paper web initially stretches and later shrinks during the course of being dried in the drying section of the paper machine. This is because, despite considerable advances in paper pressing technology, the paper web still emerges from the press section approximately only about 45% dry. The first few drying cylinders merely gradually heat up the paper web to the point where moisture evaporation begins. During this initial stage and while the paper web gives up its "free water", i.e. the water located in the interstitial spaces between the fibers of the paper web, the paper web stretches as it proceeds downstream in the machine direction. Later, the process reverses itself as the drying process releases water molecules lodged within the fibers themselves, and the paper web beings to gradually shrink.

The aforementioned Voith U.S. Pat. No. 5,311,672 patent proposes running with positive draws between the more upstream dryer sections located nearer the wet end of the drying section and running with negative draws, i.e. negative speed differentials, between those dryer sections that are located more downstream, i.e. closer to the very end, i.e. the dry end, of the drying section.

The present inventor has discovered that the prior art does not go far enough to fully compensate for the stretching and shrinking of the paper web. The difficulty stems from the fact that the typical prior art dryer sections are relatively long, containing as they do 6, 7 or even 8 or more commonly felted dryers. These commonly felted dryers run at the same, identical speeds and are traversed by a single felt in the case of single-tier dryer sections and by a pair of felts in the case of a double tier dryer section. Regardless, within any given dryer section, all the dryer surface speeds are practically identical and it is not possible to compensate for stretching and shrinking of the paper web within the dryer sections per se.

In this connection, it is noted that prior to 1990 all drying sections were constructed solely of double-tier dryer sections, each comprising a minimum of 6 dryers or more typically 8 or 10 dryers. This yields an average of approximately at least 7, and in any event, not less than 6 dryers per dryer section.

Since 1990 there has been a concerted switch over from all double-tier drying sections to drying sections comprised of either entirely single-tier dryer sections and/or of a mix of single tier and double-tier dryer sections. To date, most of the installed single tier dryer sections contain at least 5, 6 or even 7, but most typically 6 dryers per dryer section. In any event, the average number of dryers per dryer section is still greater than 5 dryers per section. Reflecting the state of the prior art is U.S. Pat. No. 4,934,067 which shows in FIG. 1 thereof 6 dryer sections each containing 6 dryers for a total of 36 dryers. This patent reflects the design of a machine that has been actually constructed, and scores of similar machines installed around the world. Similarly, the Voith Company's U.S. Pat. No. 5,050,317 shows a plurality of single felted dryer sections in which the number of dryers per dryer section is 8, or even as many as 10 dryers per section. See also, Voith's U.S. Pat. No. 5,177,880.

In drying sections containing a mix of single tier dryer sections and double tier dryer sections, the number of dryers is still on the order of about 6 dryers per dryer section, as reflected in U.S. Pat. No. 5,269,074. This patent again generally reflects the dryer layout of an actual operating drying section.

Although some prior patents have depicted dryer sections with fewer dryers, those patents are illustrative and do not reflect actual feasible machine designs which could dry a paper web from about 43% dry to 90–99% dry as required in an actual paper machine. See e.g. U.S. Pat. No. 4,982,513.

Thus, in present day drying cylinders measuring some 6 to 7 feet in diameter and having intermediate vacuum guiding rolls, a paper web length measuring well over 100 feet within any given dryer section cannot be compensated for the stretching or shrinking thereof within the dryer section. The only points of stretch/shrinkage compensation is at the web transfer zones between dryer sections where, by speeding up or slowing down a down stream dryer section, one is able to pickup the slack i.e. stretch, or compensate for the shrinkage of the paper web. Here too, there are limitations, as it is not desirable to pull a paper web too hard in the early stages of drying, because of the risk of increasing the number of web breakages.

SUMMARY OF THE INVENTION

Accordingly, it is an object of the present invention to provide a drying section which is capable of compensating for stretching and shrinking of a paper web within the dryer sections themselves.

It is another object of the present invention to provide a drying section constructed of proven drying section technology such as by using top-felted, or bottom-felted or combinations of single-tier dryer sections, which are inexpensively and simply reconfigured to provide compensation for stretching and shrinking of the paper web.

The foregoing and other objects of the present invention are realized in accordance with the present invention with a drying section which preferably comprises only top felted, single tier dryer sections, wherein each dryer section includes a considerably lesser number of drying cylinders. This flies in the face of conventional wisdom which has been striving to felt together increasing numbers of drying cylinders for reasons of cost, both in constructing the drying section and reducing the number of felts which have to be periodically replaced.

Contrary to the prior art, the present invention provides a drying section in which most of the dryer groups contain 3 or at most 4 drying cylinders. Each dryer section has a respective felt which traverses the drying cylinders as well as vacuum rolls located between each pair of adjacent dryers, below the dryers, to provide successively arranged, top felted, single tier dryer sections, in which the paper web is conveyed from section to section substantially without open draw via lick down transfers.

Preferably, the average number of drying cylinders in the dryer sections is 5 or less, but the number could be as low as below 4 and even below 3 drying cylinders per dryer section.

The vacuum guide rolls of the present invention can be located very close, i.e. in close proximity, to the drying cylinders, e.g. only about 2–5 inches away from the surfaces of the drying cylinders. Alternatively, they can be located at a distance of a foot or more from the drying cylinders and a vacuum box should then be located in the pocket defined by the drying cylinders and the vacuum roll. Moreover, the vacuum rolls may be gutless, perforated vacuum rolls in which the vacuum within is generated through a suction effect provided by the vacuum boxes located above these gutless, vacuum rolls.

Prior art drying cylinders of the same dryer group rotate at the same speeds because they are driven together due to being commonly felted or by being mechanically coupled to one or two driven cylinders. In marked departure from the prior art, the present invention provides separate direct drives to many of the drying cylinders within the dryer sections, so as to enable adjusting the paper web speed not only between dryer sections, but also within dryer sections from one dryer to the next.

Another concept introduced by the present invention is increasing the number of drying cylinders in each dryer section from the wet end toward the center of the drying section and thereafter decreasing the number of drying cylinders as the drying section extends toward the dry end thereof. This feature concentrates most of the capability of controlling dryer-to-dryer speed differentials at the early stages and at the end stages of the drying process where they are needed most, and to a lesser extent at the center region of the drying section.

Other features and advantages of the present invention will become apparent from the following description of the invention which refers to the accompanying drawings.

DETAILED DESCRIPTION OF EMBODIMENTS OF THE INVENTION

Figure 1A:
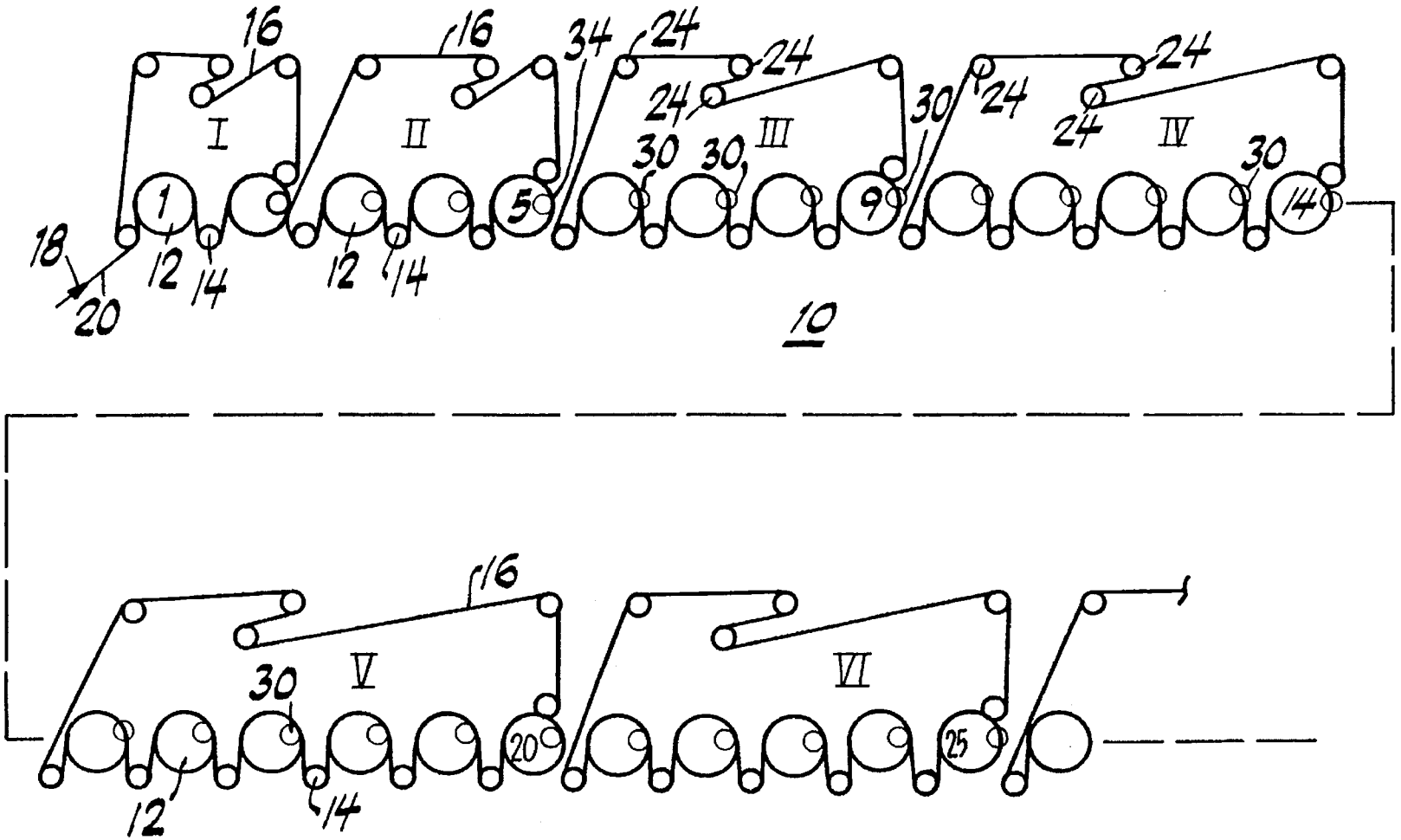
FIG. 1 diagrammatically illustrates a first embodiment of the present invention.
Figure 1B:
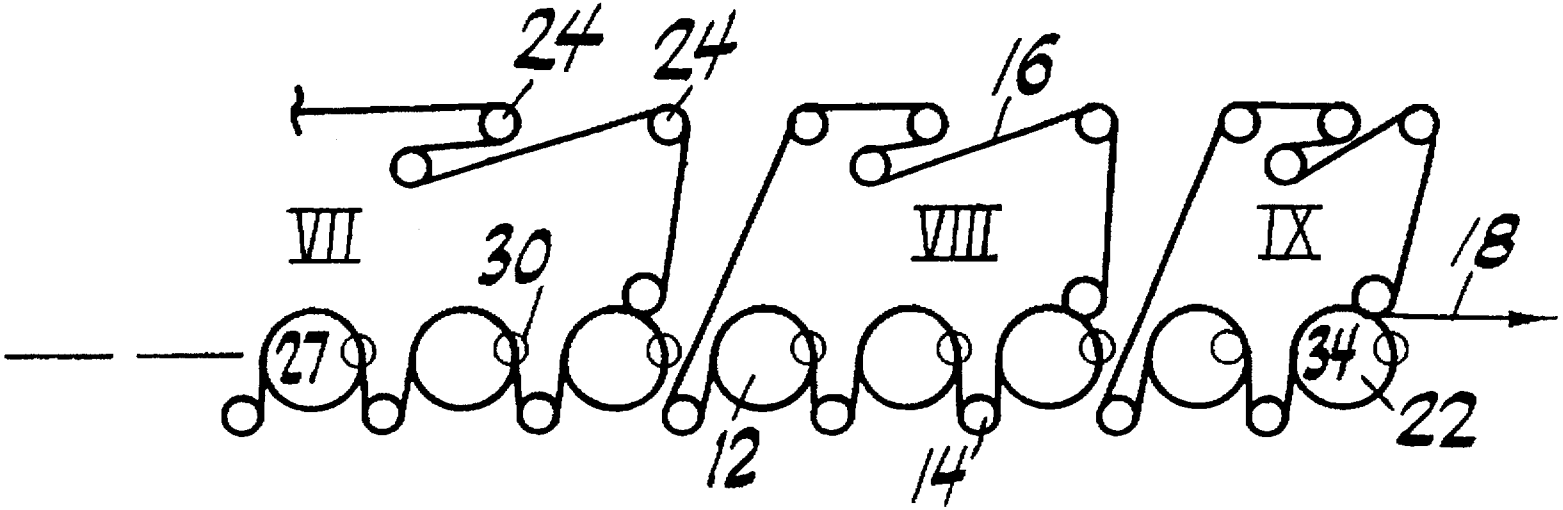

FIGS. 1A and 1B illustrate a drying section 10 which comprises nine dryer sections numbered I–IX. In a well known manner, each dryer section I–IX comprises drying cylinders 12, with vacuum rolls 14 interposed between and below the drying cylinders 12, defining top-felted, single-tier dryer sections. Each dryer section I–IX is traversed by a respective felt 16, whereby a paper web 18 has its bottom side 20 pressed against the drying cylinders 12 by the felt 16 while being guided between the dryers 12 and around the vacuum rolls 14, again in well known manner. The paper web 18 emerges from the last dryer 22 of the last dryer section IX to be thereafter conducted to other sections of the machine such as the calender, coater, after dryer, reelers etc. (not shown) as the case may be.

Note that the number of dryers in the dryer section I is 2; and that the number of dryers 12 in the remaining sections II–IX is respectively 3, 4, 5, 6, 5, 4, 3, and 2. In other words, the average number of dryers is 3.25. Second, the number of dryers is smallest at the point where the paper first emerges from the press section, where it engages the first dryer 12 of the first dryer section I. The number of dryers increases toward the center of the drying section 10 and then gradually decreases, so that the number of dryers adjacent the dry end of the drying section is 2 or perhaps 3 dryers.

As already noted, this contrasts sharply with the conventional wisdom which has advocated including more rather than less dryers within a dryer section, to reduce the number of felts 16, felt rolls 24 and other components of the drying section.

In addition to comprising only an average of 3.25 dryers per dryer section, the drying section 10 of FIGS. 1A and 1B is distinguished from the prior art in that it comprises 9 dryer sections which is well over the typical 4 or at most 5 dryer sections associated with double tier drying sections and the 6 dryer sections or at most 7 dryer sections which have been provided in prior art, all single tier drying sections. It should be noted that although the drying section 10 of FIGS. 1A and 1B provides an average of 3.25 dryers per dryer section, the concept of the present invention extends generically to dryer sections which have on average below about 5.5 dryers per dryer section.

In the drying section 10 of the present invention the paper web 18 is initially heated and the evaporation process begins in the more upstream dryer section I–IV, which are located nearer the wet end of the drying section. It is there that the paper web may initially stretch and thus sag so that it does not properly and firmly adhere to the exterior face of the felt 16 as that felt traverses the vacuum rolls 14. This can cause web breakage, web wrinkling and otherwise adversely affect the final paper quality.

In contrast, during the later stages of the drying process, e.g. while the paper web is being dried at the dryer sections VI–IX, the paper web may begin to shrink. That shrinkage has to be accommodated to prevent the paper web from breaking.

To compensate for both the stretching and/or wrinkling of the paper web during the early drying stages and the possible web bursting in the later stages, the present invention also provides individual drives for many or even all of the dryers 12. This feature is illustrated as respective drive mechanisms 30 coupled to the individual dryers 12, which enable providing relatively small dryer-to-dryer speed variations within the same dryer section. The dryer drive mechanisms 30 are per se known in the art as can be appreciated from the Voith Company's U.S. Pat. Nos. 5,311,672 and 4,820,947, the contents of which are incorporated by reference herein.

Although FIGS. 1A and 1B illustrate a respective drive for each of the dryers 12, it is not necessary that each dryer be provided with a separate drive. Rather, it is important to provide the drives 30 where it is deemed that the stretching or shrinking will take place, to accommodate and compensate such stretching and/or shrinking. In this connection note that if the felts 16 grip the drying cylinders very tightly it is possible to stretch the fabric somewhat by speeding up a downstream dryer, thus picking up the slack, i.e. the stretch of the paper web. Conversely, toward the dry end of the drying section, because the felt tightly grips the dryers it is normally somewhat stretched whereby slowing down a downstream dryer has the potential of relieving or relaxing somewhat the stresses in the paper web which, in conjunction with the use of very small dryer groups and negative draws between the groups, can fully compensate for the web shrinkage. This realizes substantial and improved control of the paper web stretching/shrinking properties throughout the drying section.

Throughout the instant description, references to driving of the dryers is intended to include the vacuum rolls. Thus, either the dryers, or the vacuum rolls or combinations thereof may be driven to obtain the above-described control over shrinking and/or stretching of the paper web.

Figure 5:
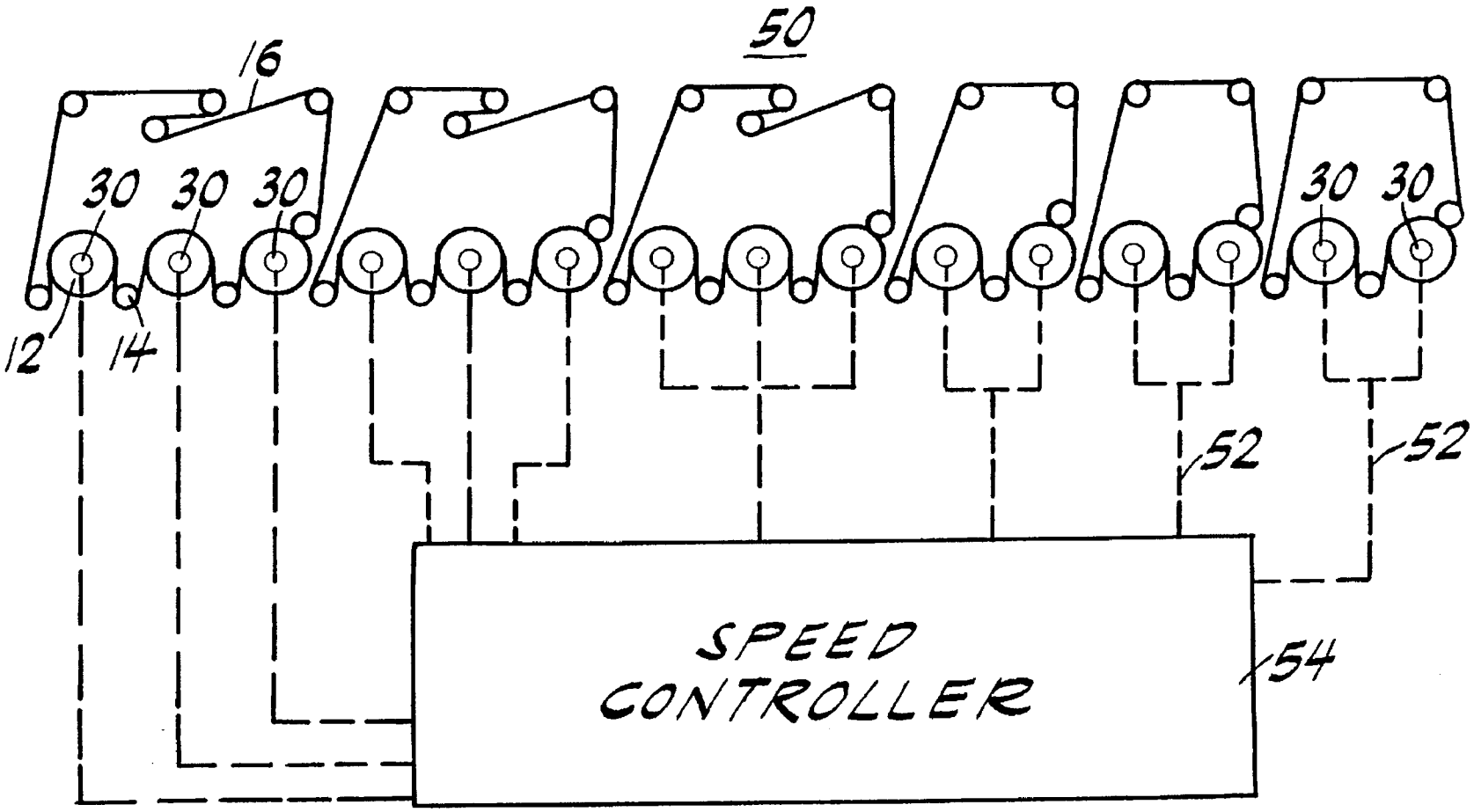
FIG. 5 illustrates a dryer-to-dryer speed controller.

FIG. 5 shows a drying section 50 which, like the drying section 10 of FIGS. 1A and 1B, includes drying cylinders 12, vacuum rolls 14, individual dryer drivers 30 and felts 16. Although a actual paper machine drying section would require more than the illustrated 15 dryers, this drawing nevertheless shows a drying section variant of the present invention in which the number of dryers per dryer section is either 2 or 3, for an average of about 2.5 dryers. Also note the individual lines 52 which couple the drivers 30 to a central speed controller or governor 54, by which the speeds of the individual dryers may be controlled in accordance with the concept of the present invention.

Figure 2:
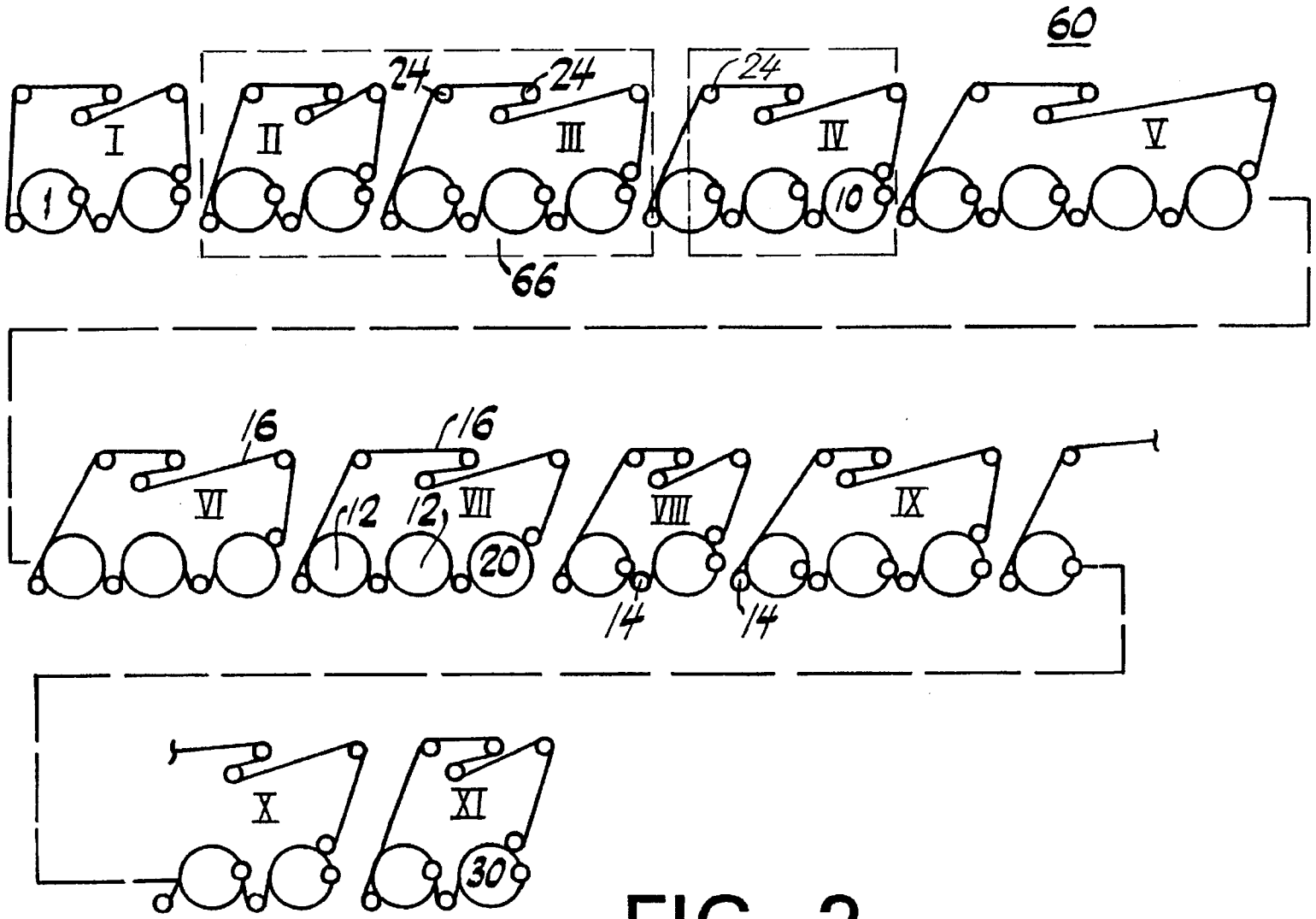
FIG. 2 illustrates a second embodiment of the present invention.

Similarly, FIG. 2 illustrates a drying section 60 with 11 dryer sections numbered I–XI which contain felts 16, dryers 12, vacuum rolls 14, felt rolls 24, drivers 30, etc. The eleven dryer sections comprising the dryer section 60 is about twice or even as much as almost four times the number of dryer sections found in conventional drying sections.

Figure 3:
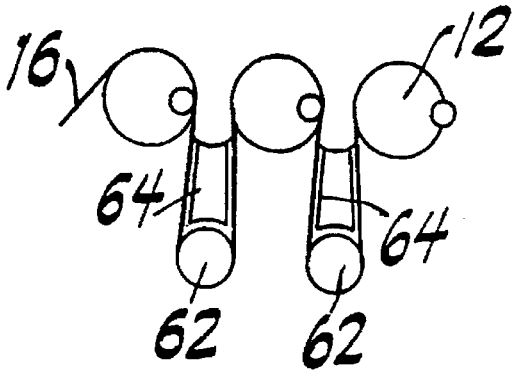
FIG. 3 illustrates the use of vacuum boxes and long evaporation paths in the embodiments of FIGS. 1A, 1B and 2.

FIG. 3 illustrates that the present invention as illustrated in FIGS. 1A, 1B, 2 and 5 is not limited to vacuum rolls 14 which are located in close proximity to the dryers 12. That is, the concepts of the invention are applicable to and may be realized by using vacuum rolls 62, which may be gutless vacuum rolls that are located at a considerable distance, e.g. one foot to 18 inches away from the surfaces of the drying cylinders 12. The vacuum here is supplied from vacuum boxes 64 which provide a vacuum for holding the paper web against the felt 16 over the joint run of web-felt between dryers and around the vacuum roll 62.

Figure 4:
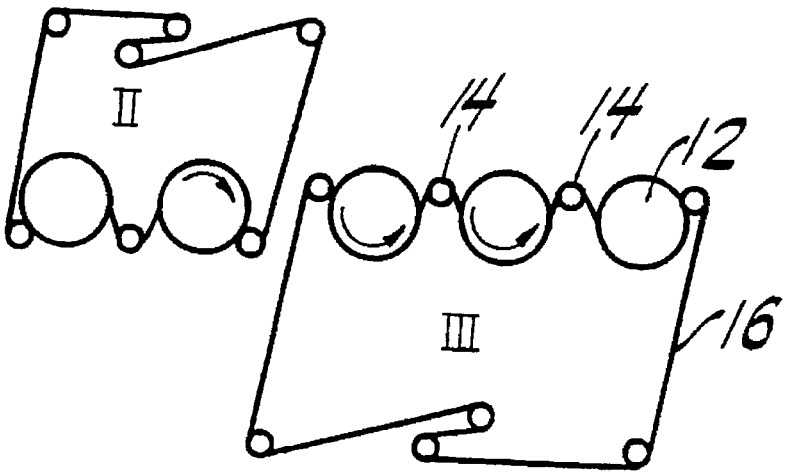
FIG. 4 illustrates an alternating single tier drying section variant for the embodiments of FIGS. 1A, 1B and 2.

In the same vein, the present invention is not limited to the all top felted, single tier dryer sections illustrated in FIGS. 1A, 1B, 2 and 5. Rather, as shown in FIG. 4, successive ones of these dryer sections can be alternatingly inverted, so that the dryers 12 in the boxed area 66 in FIG. 2 can be oriented so that the dryers in the third dryer group III are arranged at a lower plane, below the dryers of the second section II and the vacuum rolls 14 are located above the dryers as shown. Here the felt 16 completes its loop around the dryers by traveling below the dryers, resulting in a bottom-felted dryer section in which the dryers 12 rotate counterclockwise, opposite to the clockwise rotating cylinders of the top felted dryer section.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A method for drying a paper web in a drying section of a papermaking machine, the method comprising the steps of:

guiding the paper web through a drying section comprising a plurality of dryer sections, each dryer section including a number of dryers and a respective felt serving to press the paper web against the dryers, at least several of the dryers in at least several of the dryer sections being individually driven in a manner enabling dryer-to-dryer speed differentials within dryer sections; and adjusting dryer-to-dryer speeds between several of the individually driven dryers to compensate for stretching and/or shrinkage of the paper web.

2. The paper web drying method of claim 1, further including controlling the stretching and shrinkage of the paper web throughout the drying section.

3. The paper web drying method of claim 1, in which at least several of the dryer sections include less than four dryers.

4. The paper web drying method of claim 1, including adjusting the draw between dryer sections to further compensate for stretching and/or shrinking of the paper web.

5. The paper web drying method of claim 1, in which the drying section comprises one group of dryer sections located nearer a wet end of the drying section and a second group of dryer sections located nearer a dry end of the drying section, the average number of dryers in all of the dryer sections being less than five.

* * * * *